US005994693A

United States Patent [19]

Vilani

[11] Patent Number: 5,994,693

[45] Date of Patent: Nov. 30, 1999

[54] GAMMA CAMERA QUALITY TEST PATTERN

[75] Inventor: Joseph W. Vilani, Williamsville, N.Y.

[73] Assignee: The Research Foundation of SUNY at Buffalo, Amherst, N.Y.

[21] Appl. No.: 08/998,503

[22] Filed: Dec. 26, 1997

Related U.S. Application Data

[60] Provisional application No. 60/033,997, Jan. 3, 1997.

[51] Int. Cl.[6] ..... G21K 1/00

[52] U.S. Cl. ..... 250/252.1; 378/207

[58] Field of Search ..... 250/252.1; 378/207

[56] References Cited

U.S. PATENT DOCUMENTS

| | | | |
|---|---|---|---|
| 2,258,593 | 10/1941 | Black | 378/207 |
| 3,005,912 | 10/1961 | Babcock | 378/58 |
| 3,995,959 | 12/1976 | Shaber | 356/443 |
| 4,280,047 | 7/1981 | Enos | 250/252.1 |
| 4,419,577 | 12/1983 | Guth | 250/252.1 |
| 4,460,832 | 7/1984 | Bigham | 250/505.1 |
| 4,472,829 | 9/1984 | Riederer et al. | 378/207 |
| 4,628,342 | 12/1986 | Desmons et al. | 348/188 |
| 4,757,207 | 7/1988 | Chappelow et al. | 250/491.1 |
| 5,040,199 | 8/1991 | Stein | 378/56 |
| 5,056,130 | 10/1991 | Engel | 378/207 |
| 5,164,978 | 11/1992 | Goodenough et al. | 378/207 |
| 5,841,835 | 11/1998 | Aufrichtig et al. | 378/207 |

*Primary Examiner*—Constantine Hannaher
*Assistant Examiner*—Albert Gagliardi
*Attorney, Agent, or Firm*—Simpson, Simpson & Snyder

[57] ABSTRACT

A gamma camera quality test pattern having a substrate which is substantially transparent to gamma radiation, the substrate having four quadrants, each quadrant containing a set of spaced L-shaped grooves filled with a material that is essentially opaque to gamma radiation.

11 Claims, 3 Drawing Sheets

GAMMA CAMERA QUALITY TEST PATTERN

Applicant hereby claims the benefit under 35 U.S.C. § 119(e) of U.S. Provisional Application Ser. No. 60/033,997, filed Jan. 3, 1997.

BACKGROUND OF THE INVENTION

The present invention relates generally to a gamma camera quality test pattern. More specifically, the invention relates to a test pattern which requires only a single image acquisition to evaluate spatial resolution and linearity, thereby greatly reducing the time necessary to test gamma camera quality.

Other test patterns are known in the art. For example, U.S. Pat. No. 4,419,577 (Guth) discloses a test pattern device for a radiation detector which comprises a radiation transparent body member having internal mercury-filled communicating passages which define a calibrated radiation opaque test pattern. Unfortunately, the geometry and structure of this patented test pattern requires multiple image acquisitions to meet standard state test requirements.

Another test pattern is disclosed in U.S. Pat. No. 4,757,207 (Chappelow et al.). This pattern also requires multiple acquisitions to meet standard state test requirements.

What is needed, then, is a gamma camera quality test pattern which reduces the number of image acquisitions necessary to meet state requirements for testing of camera quality.

SUMMARY OF THE INVENTION

The invention comprises a gamma camera quality test pattern having a substrate which is substantially transparent to gamma radiation, the substrate having four quadrants, each quadrant containing a set of spaced L-shaped grooves filled with a material which is opaque to gamma radiation.

A primary object of the present invention is to provide a test pattern which simplifies and reduces the time required to test the quality of gamma cameras.

These and other objects and advantages of the invention will readily become apparent to those having ordinary skill in the art in view of the following detailed description, drawings and appended claims.

DESCRIPTION OF THE PREFERRED EMBODIMENT

Figure 1A:
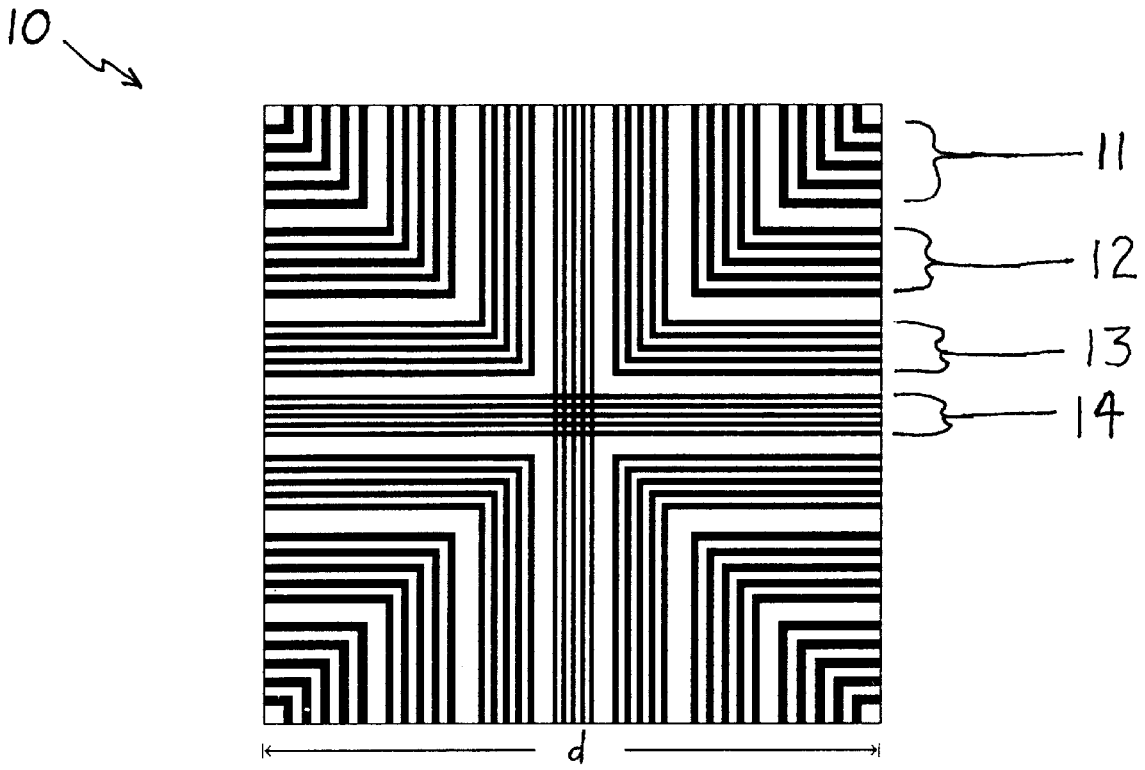
FIG. 1A is a top plan view of the test pattern of the invention.

At the outset, it should be clearly understood that like reference numerals are intended to identify the same structural elements, portions or surfaces consistently throughout the several drawing figures as such elements, portions or surfaces may be further described or explained by the entire written specification, of which this detailed description is an integral part. Unless otherwise indicated, the drawings are intended to be read together with the specification, and are to be considered a portion of the entire "written description" of this invention.

The following are definitions of words and phrases used in this description:

"Heavy metal" is a metal having a specific gravity of greater than 5.0.

"Fusible alloy" generally means alloys melting below 233° C.

"Eutectic alloy" is a subclass of fusible alloy that has a particular compositions that have definite and minimum melting points as compared with other compositions of the same material. Eutectic metals are binary, ternary, quaternary and quinary mixtures of bismuth, lead, tin, cadmium, indium and less frequently other metals. Usually, the eutectic metals have about 44 to 60% bismuth, up to 45% lead, up to 42% tin, and up to 10% cadmium.

Common eutectic metals include, but are not limited to, the following:

| | | Percentage Compositions | | | |
|---|---|---|---|---|---|
| Alloys | M.P. ° C. | Bi | Pb | Sn | Cd |
| Newton' metal | 95 | 50 | 31 | 19 | |
| Rose's alloy | 100 | 50 | 28 | 22 | |
| Darcet's alloy | 93 | 50 | 25 | 25 | |
| Wood's alloy | 71 | 50 | 24 | 14 | 12 |
| Wood's metal | 71 | 50 | 25 | 12.5 | 12.5 |
| Lipowitz's alloy | 70 | 50 | 27 | 13 | 10 |

The invention is a unique gamma camera quality test pattern which evaluates either the intrinsic or system spatial resolution and linearity performance of a gamma camera. The pattern comprises a substrate which is essentially transparent to gamma radiation, the substrate containing L-shaped grooves which are filled with a material which is essentially opaque to gamma radiation. FIG. 1A is a top plan view of the substrate of the preferred embodiment of the invention. In this embodiment, the substrate is preferably constructed of Lexan® brand plastic sheet with precisely machined sets of equally spaced parallel grooves in an "L-shaped" pattern as shown. Although dimensions may vary, in a preferred embodiment, a sheet having dimensions (d) of 20"×20" and a thickness of ⅜". The substrate can be made of any suitable material which is transparent to gamma radiation and capable of machining for the grooves. The substrate may be made of other thicknesses as well. The dimensions of the width and depth of the grooves can also vary. In the preferred embodiment shown in Figures 1A and 1B, plurality of grooves 11 are ¼" wide, plurality of grooves 12 are 3/16" wide, plurality of grooves 13 are 5/32" wide, and plurality of grooves 14 are 1/10" wide.

Figure 1B:
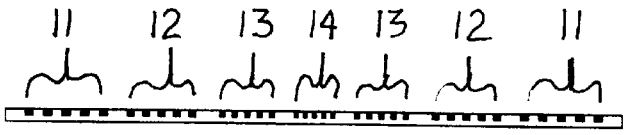
FIG. 1B is a cross-sectional view of the test pattern shown in FIG. 1A.

The machined grooves are filled with a material which is essentially opaque to gamma radiation. Although the depth of the filled grooves may vary, in the preferred embodiment shown, the grooves are filled to a depth of 3/16", as shown in FIG. 1B. The material within the grooves may be a heavy metal (e.g., lead). The heavy metal may be a fusible alloy. The fusible alloy may be a eutectic alloy. In a preferred embodiment, a Cerrobend metal alloy was used, consisting of 50% bismuth, 26.7% lead, 13.3% tin, and 10% cadmium (Cerrobend is a trademark of Cerro Corporation). There are several advantages of Cerrobend alloys over pure lead, including:

1. Cerrobend alloys are eutectic metals that melt/solidify at approximately 160° F. and can be easily cast into the machined plastic test pattern, without warping or melting the plastic substrate.

2. Cutting lead bars can avoid the heat/melting problem but extreme precision must be maintained so that bar width dimensions are kept to very close tolerances.
3. Cerrobend alloys expand slightly after solidification so there is no shrinkage or chance that the cast metal bar will dislodge from the pattern. This results is a good tight fit of the metal within the machined grooves of the substrate.

The material in the grooves functions to attenuate gamma radiation when the pattern is placed between the gamma camera detector and a radioactive point or "flood" source. The composition of Cerrobend alloy described above results, theoretically, in only a 0.04% transmission of 150 keV (e.g., Tc-99m) gamma rays through a 3/16" thick bar. This is greater than pure lead (which would allow transmission of 0.002%) but is still acceptable for imaging. In other words, the use of the Cerrobend alloy does not compromise transmission quality of the test pattern. The following are the calculations relative to transmission:

| Element | Fractional Composition | Density ($g/cm^3$) | Mass Attenuation Coefficient ($\mu m$) |
|---|---|---|---|
| bismuth | 0.50 | 9.747 | 1.97 $cm^2/g$ |
| lead | 0.267 | 11.35 | 1.97 $cm^2/g$ |
| tin | 0.133 | 7.31 | 0.614 $cm^2/g$ |
| cadmium | 0.10 | 8.65 | 0.614 $cm^2/g$ |

The total effective linear attenuation coefficient ($\lambda$) for Cerrobend is approximately: $\pi=(1.97\cdot9.747\cdot0.5)+(1.97\cdot11.36\cdot0.267)+(0.614\cdot7.31\cdot0.133)+(0.614\cdot8.65\cdot0.10)$ $\lambda=(9.33)+(5.97)+(0.60)+(0.53)=16.43\ cm^{-1}$ The $\lambda$ for lead is 22.38 $cm^{-1}$ The transmission factor is$=e^{-\mu x}$, where x is the thickness of the bar in centimeters. Transmission through Cerrobend$=e^{-(16.43\cdot0.48)}=0.00039$ or ~0.04% Transmission through pure lead$=e^{-(22.38\cdot0.48)}=0.00002$ or ~0.002%

The shadows created by the pattern can be used to evaluate the nuclear imager's performance. The uniqueness of this design results in the necessity for only one acquired image per camera detector head system to evaluate performance for quality control records. Current commercial patterns require multiple images in order to evaluate linearity and resolution over the entire field of view of the detector.

Figure 2:
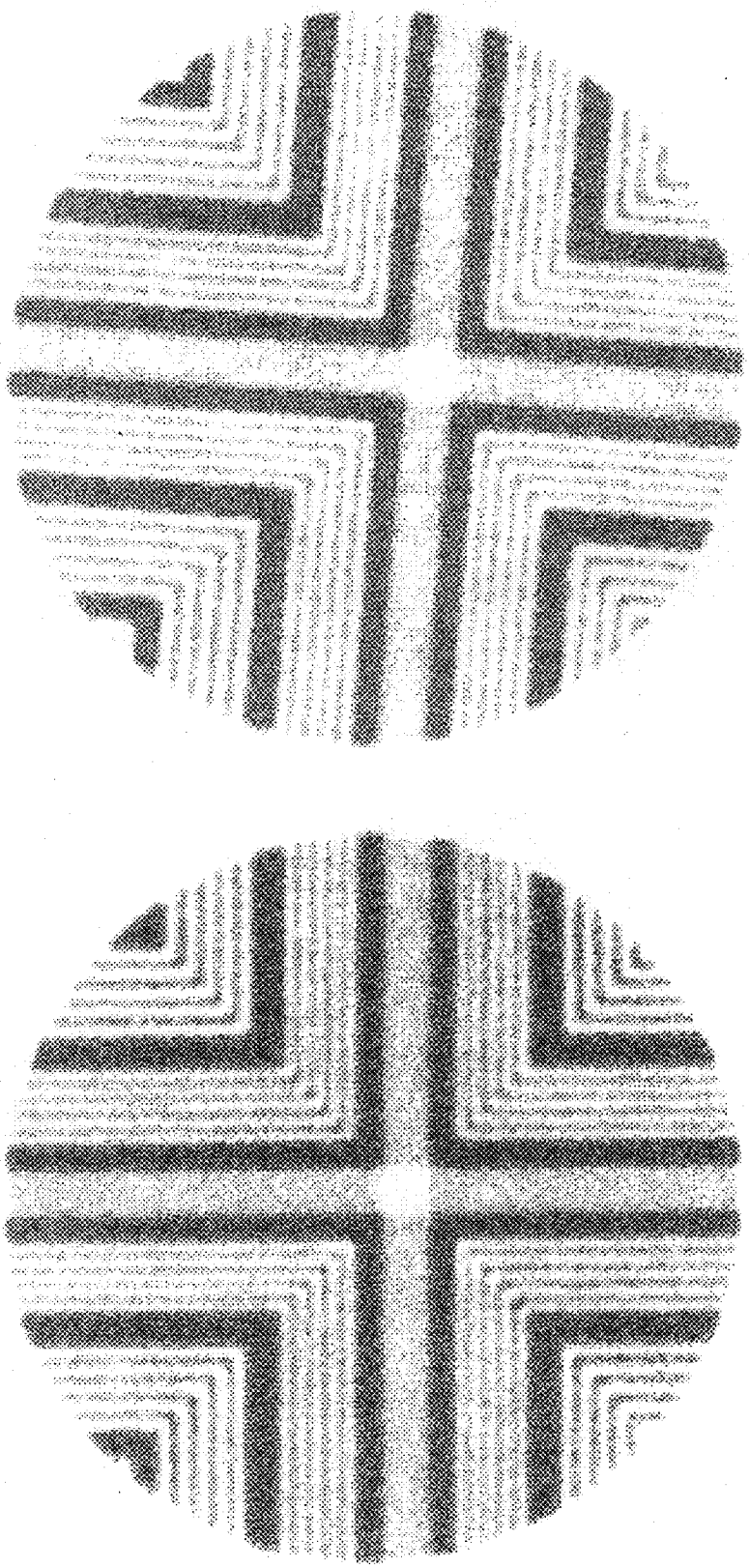
FIG. 2 is a copy of a first actual gamma camera image obtained with the test pattern of the present invention; and, FIG. 3 is a reproduction of an actual negative of a second actual gamma camera image obtained with the test pattern of the present invention.

FIG. 2 is a copy of a first actual gamma camera image 15 obtained with the test pattern of the present invention.

Figure 3:
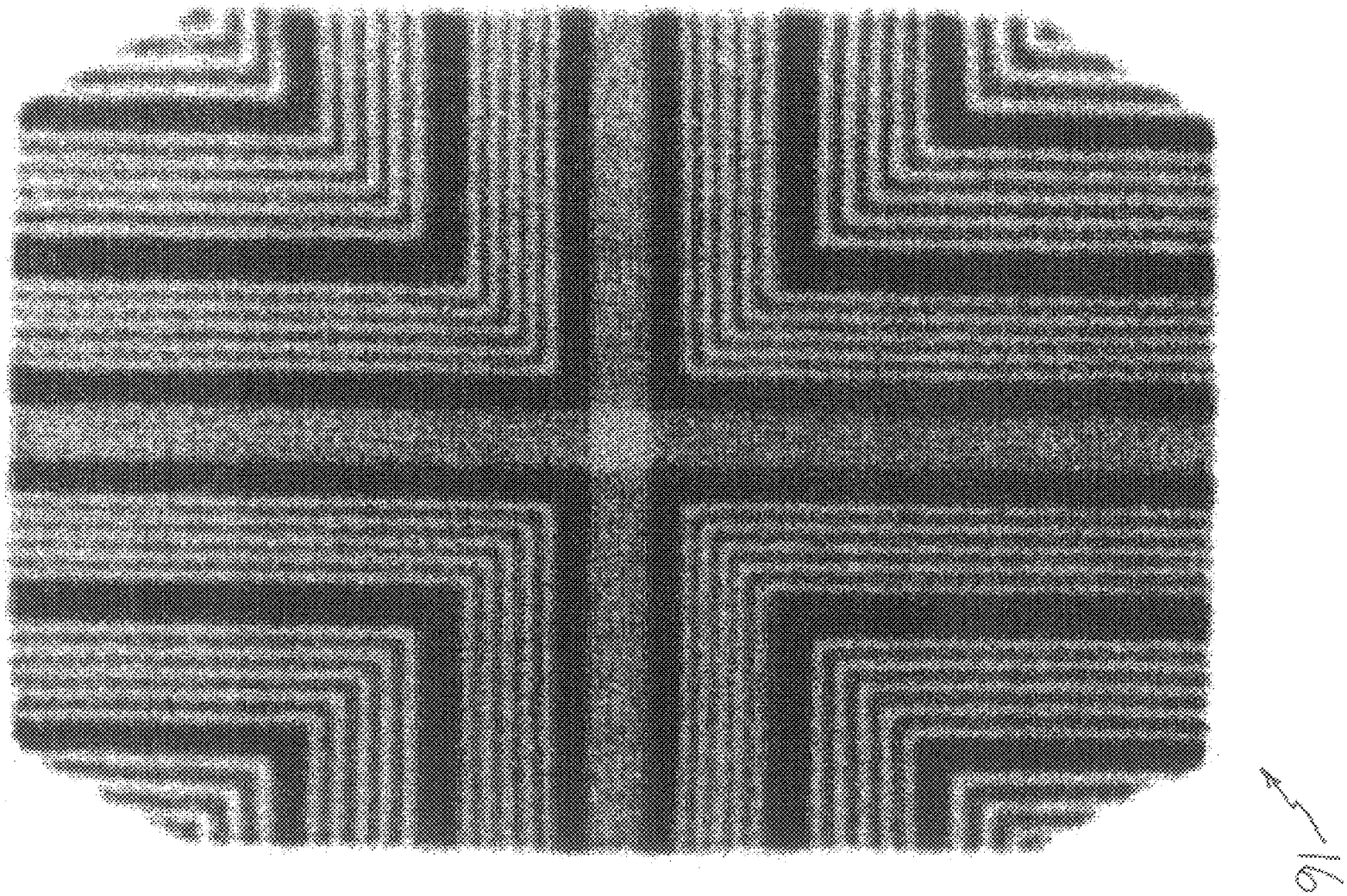

FIG. 3 is a reproduction of an actual negative 16 of a second actual gamma camera image obtained with the test pattern of the present invention.

Advantages of the Technology

The test pattern needs only one image acquisition on a gamma camera to evaluate spatial resolution and linearity. This reduces mandatory quality control testing to one quarter of the time necessary to meet certain State (e.g., New York State) requirements compared to using a commercially available 90° bar quadrant test pattern. The time savings allows increased patient imaging on the gamma camera resulting in more studies to be performed on the imaging system.

Routine quality control tests are required by the State of New York (and other states) to show that a nuclear imaging (gamma camera) is operating within the manufacturer's design specifications. Spatial linearity and resolution testing are required to be performed weekly on each gamma camera in an active nuclear medicine clinic. The NYS Department of Health regulatory guide states that the camera's linearity and resolution should be tested extrinsically (lead collimator in place) with one of the following types of transmission test patterns:

1. A four frequency equal spaced bar pattern usually referred to as "90° bar pattern". This pattern must be imaged four times, rotating the pattern 90° each time in order to satisfy the State regulatory guide. Older NYS DOH licensees may be required to flip the pattern and re-image an additional four times to satisfy license requirements.
2. A single frequency parallel line equally spaced (PLES) pattern can be used. The pattern must be imaged twice, rotating the pattern 90° each time in order to satisfy the State regulatory guide.
3. A single frequency orthogonal hole pattern can be used. This pattern is imaged only one time during a weekly QC test.

The State will accept any of these test patterns, however, they may not truly test the performance of the nuclear imaging system. The "90° bar pattern" is the better of the test patterns since it allows an operator to see gradual changes in resolution due to its four pattern frequencies. This is the most common pattern found in a nuclear medicine clinic. The disadvantage of this pattern is that it must be imaged four times, increasing the imager's down time. The new generation three-headed single photon emission computed tomography (SPECT) gamma cameras would require 12 images to satisfy the NYS DON QC requirement.

The PLES pattern requires only two images but lacks the ability to truly test spatial resolution since it only has one frequency to evaluate. There are only two frequencies available for a PLES. One pattern has a frequency (resolution) that is incapable of being visualized on a gamma camera with a collimator in place. The other PLES has a bar pattern that is really too coarse to evaluate extrinsic spatial resolution.

The standard orthogonal hole test pattern requires only one image. However, it has only one frequency to evaluate resolution. Additionally, the choice of the hole diameter is critical. Small diameter holes are better for resolution testing but usually produce a Moire artifact rendering the image useless. Larger holes can alleviate the Moire artifact but do not truly test the resolution capability of the imaging system. A "BRH" orthogonal pattern is available with variable frequencies. However, this pattern is for intrinsic testing only.

This invention provides the resolution and linearity capability of the "90° bar pattern" in only one image acquisition. The pattern can evaluate either the intrinsic or the extrinsic spatial resolution and linearity performance of modern gamma cameras. The pattern was designed, constructed and tested at SUNY Buffalo. The pattern is manufactured from a 20"×20"×3/8" Lexan® plastic sheet that has been precisely machined with four sets of equally spaced parallel lines in an "L-shaped" pattern. The machined line sets were filled (cast) with a high atomic numbered, high density metal alloy. The alloy is used to attenuate the gamma radiation (i.e., x-rays) when the pattern is placed between the gamma camera and a radioactive "flood" transmission source. The shadows created by the pattern can be used to evaluate the camera's spatial resolution (i.e., the ability to see small objects) and spatial linearity (i.e., the ability to correctly position image data). The uniqueness of this design requires that only one image per camera detector head be acquired in order to evaluate the performance for QC testing. The pattern provides all of the benefits of the "90° bar pattern" at ¼ of the imaging time. The pattern is superior to PLES and orthogonal type patterns.

It will thus be seen that the objects set forth above, among those made apparent from the preceding description, are efficiently obtained. Since certain changes may be made in carrying out the above invention and in the constructions set forth without departing from the scope of the invention, it is intended that all matter contained in the above description or shown in the accompanying drawings be interpreted as illustrative and not in a limiting sense. It is also to be understood that the following claims are intended to cover all of the generic and specific features of the invention herein described, and all statements of the scope of the invention, which, might be said to fall therebetween.

What is claimed is:

1. A gamma camera quality test pattern comprising a substrate which is substantially transparent to gamma radiation, said substrate having four quadrants, each quadrant containing a set of spaced L-shaped grooves filled with a material that is essentially opaque to gamma radiation.

2. A gamma camera quality test pattern as recited in claim 1 wherein said substrate is made of plastic.

3. A gamma camera test pattern as recited in claim 2 wherein said plastic substrate is comprised of a polycarbonate resin.

4. A gamma camera test pattern as recited in claim 1 wherein said gamma opaque material is a heavy metal.

5. A gamma camera test pattern as recited in claim 4 wherein said heavy metal is lead.

6. A gamma camera test pattern as recited in claim 4 wherein said heavy metal is a fusible alloy.

7. A gamma camera test pattern as recited in claim 6 wherein said fusible alloy is a eutectic alloy.

8. A gamma camera test pattern as recited in claim 7 wherein said eutectic alloy is selected from the group consisting of Newton's metal, Rose's alloy, Darcet's alloy, Wood's alloy, Wood's metal, and Lipowitz's alloy.

9. A gamma camera test pattern as recited in claim 1 wherein each quadrant contains a plurality of sets of spaced L-shaped grooves filled with a material that is essentially opaque to gamma radiation.

10. A gamma camera test pattern as recited in claim 9 wherein all grooves within a particular set of grooves have the same width.

11. A gamma camera test pattern as recited in claim 10 wherein each set of grooves contains grooves of a width which is different than the width of grooves in any other set.

* * * * *